US006895850B2

(12) United States Patent
Hagan et al.

(10) Patent No.: US 6,895,850 B2
(45) Date of Patent: May 24, 2005

(54) PRESSURE-RELEASED BRAKE ASSEMBLY FOR RESTRAINING PROJECTILE IN LAUNCH TUBE

(75) Inventors: James Dennis Hagan, Fredericksburg, VA (US); James N. Malamas, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 70 days.

(21) Appl. No.: 10/658,581

(22) Filed: Sep. 9, 2003

(65) Prior Publication Data

US 2005/0066800 A1 Mar. 31, 2005

(51) Int. Cl.[7] ..... F41F 3/52
(52) U.S. Cl. ..... 89/1.806; 89/1.812
(58) Field of Search ..... 89/1.806, 1.812; 244/3.25, 3.27

(56) References Cited

U.S. PATENT DOCUMENTS

| | | | | | |
|---|---|---|---|---|---|
| 3,106,132 | A | * | 10/1963 | Biemann | 89/1.815 |
| 3,166,981 | A | * | 1/1965 | Harris | 89/1.806 |
| 3,266,373 | A | * | 8/1966 | Brown | 89/1.806 |
| 3,893,366 | A | * | 7/1975 | Murray | 89/1.801 |
| 4,012,988 | A | | 3/1977 | Knight | 89/1.806 |
| 4,016,796 | A | | 4/1977 | Brannan | 89/1.806 |
| 4,026,189 | A | | 5/1977 | Akhagen et al. | 89/1.703 |
| 4,184,408 | A | | 1/1980 | Smith et al. | 89/1.806 |
| 4,336,740 | A | | 6/1982 | Leigh et al. | 89/1.806 |
| 4,453,449 | A | | 6/1984 | Hollmann | 89/1.806 |
| 4,550,640 | A | * | 11/1985 | Harter | 89/1.806 |
| 5,098,236 | A | | 3/1992 | Fischer | 410/77 |
| 5,714,708 | A | | 2/1998 | Shim et al. | 89/1.806 |
| 6,369,373 | B1 | | 4/2002 | Tepera et al. | 244/3.3 |
| 6,769,345 | B2 | * | 8/2004 | Grange et al. | 89/1.816 |

* cited by examiner

*Primary Examiner*—Michael Carone
*Assistant Examiner*—Troy Chambers
(74) *Attorney, Agent, or Firm*—Matthew J. Bussan, Esq.; Scott R. Boalick, Esq.

(57) ABSTRACT

A pressure-released brake assembly restrains a projectile in a launch tube prior to launch and automatically releases the projectile at launch. A brake assembly housing defines cavities that extend substantially radially out from the projectile when the housing is attached thereto. A brake pad adjoins the housing and has holes formed therethrough with each hole being aligned with one of the housing's cavities. Means are provided for positioning a loose-fitting pin partially in each of the brake pad's holes and partially in a correspondingly aligned housing cavity. When a launch pressure is generated in the projectile's launch tube, the launch pressure acts on each pin via the holes in the brake pad. The launch pressure causes the positioning means to fail and drives each pin out of engagement with the brake pad to effectively uncouple the brake pad from the housing.

23 Claims, 2 Drawing Sheets

FIG.4
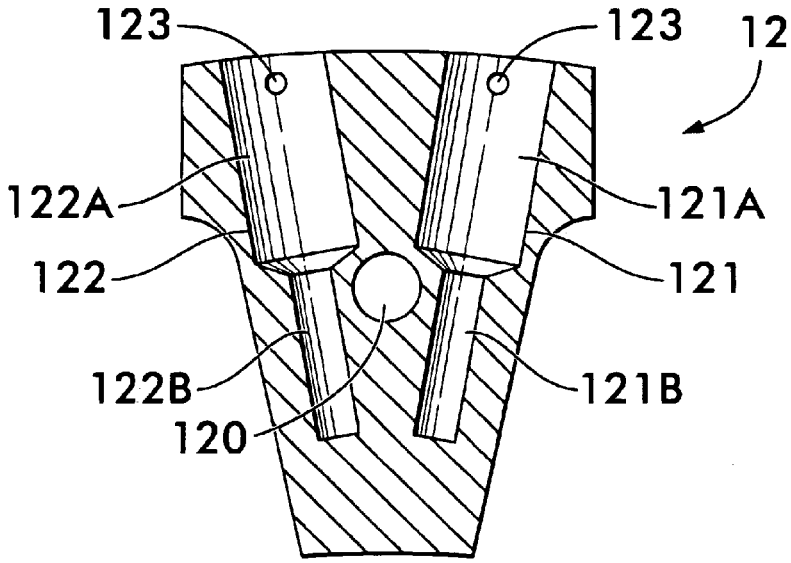
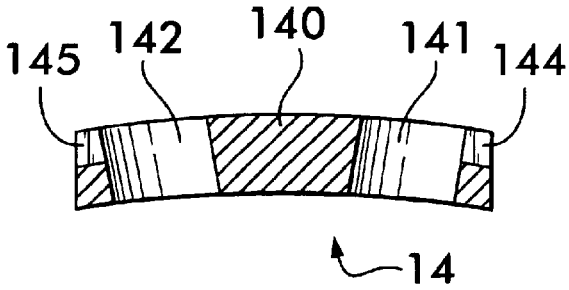
FIG.5
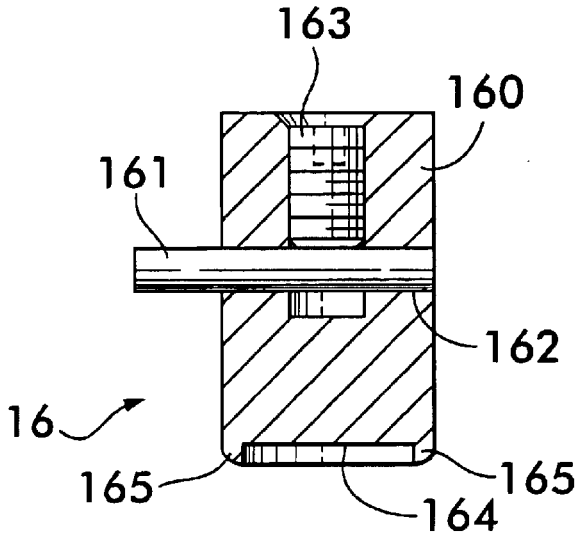
FIG.6

PRESSURE-RELEASED BRAKE ASSEMBLY FOR RESTRAINING PROJECTILE IN LAUNCH TUBE

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to projectile restraining mechanisms, and more particularly to a brake assembly that can restrain a projectile in a launch tube and automatically release the projectile using gas pressure developed during launch of the projectile.

BACKGROUND OF THE INVENTION

Many projectile launchers require that a projectile be forcibly rammed into a launch tube in preparation for firing the projectile. Typically, the projectile must be stopped at a certain location in the launch tube and then restrained at that location until the projectile is to be launched. Then, at launch, the projectile must be released so that it can move freely in the launch tube under the force of a launch pressure applied to the aft end of the projectile. Thus, a restraint and release means must provide a two-part functionality. That is, it must be strong enough to brake and then restrain a rammed projectile, while also being weak enough to structurally fail so that the projectile is free to move in the launch tube when it is fired therefrom.

SUMMARY OF THE INVENTION

Accordingly, it is an object of the present invention to provide a brake assembly that can brake and restrain a projectile rammed into a launch tube, and then automatically release the projectile at time of launch.

Another object of the present invention is to provide a brake assembly that can brake and restrain a projectile rammed into a launch tube, and then automatically release the projectile when a launch pressure is generated at the aft end of the projectile.

Other objects and advantages of the present invention will become more obvious hereinafter in the specification and drawings.

In accordance with the present invention, a pressure-released brake assembly restrains a projectile in a launch tube prior to launch and automatically releases the projectile at launch. The brake assembly has a housing configured for fixed attachment to the projectile. The housing defines cavities therein where each cavity has a longitudinal axis that extends substantially radially out from the projectile when the housing is attached thereto. At least two of the cavities are angled towards one another. A brake pad adjoins the housing and has holes formed therethrough with each hole being aligned with one of the housing's cavities. A pin, that loosely fits in each of the brake pad's hole and a correspondingly aligned cavity, is positioned partially in the hole and partially in the correspondingly aligned cavity. As a result, the brake pad is coupled to the housing. Such positioning can be accomplished using a wire that passes through the housing and the pin. When a launch pressure is generated in the projectile's launch tube, the launch pressure acts on each pin via the holes in the brake pad. The launch pressure causes the pin positioning wire to fail and drives each pin out of engagement with the brake pad to effectively uncouple the brake pad from the housing.

BRIEF DESCRIPTION OF THE DRAWINGS

FIG. 4 is an isolated cross-sectional view of the brake assembly's housing;

FIG. 5 is a isolated cross-sectional view of the brake assembly's brake pad; and FIG. 6 is an isolated cross-sectional view of one of the brake assembly's pin assemblies.

DETAILED DESCRIPTION OF THE INVENTION

Figure 1:
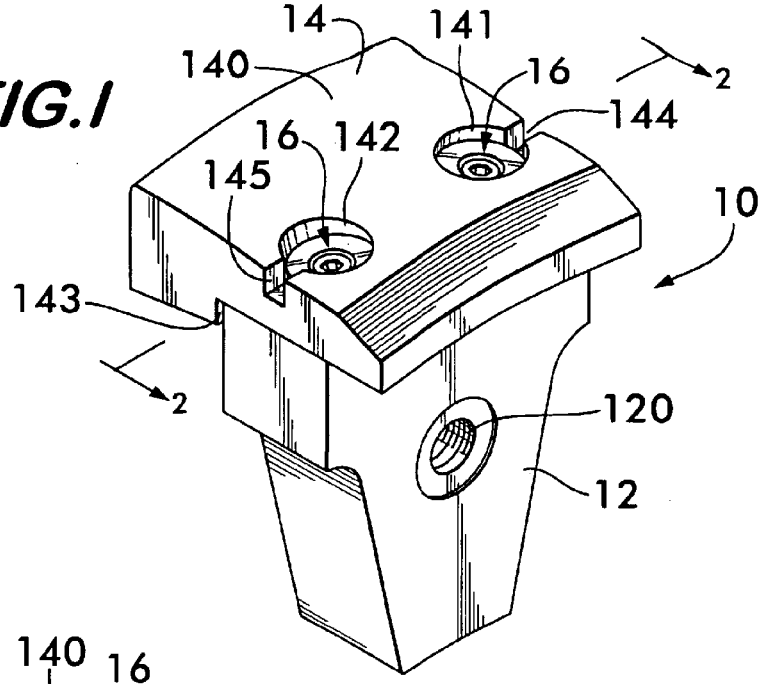
FIG. 1 is a perspective view of an embodiment of the pressure-released brake assembly in accordance with the present invention.
Figure 2:
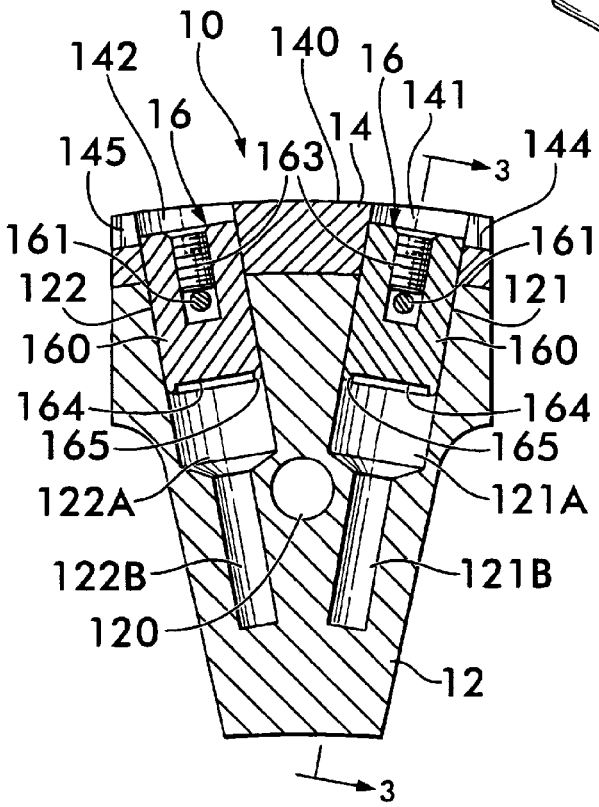
FIG. 2 is a cross-sectional view of the brake assembly taken along line 2—2 in FIG. 1.
Figure 3:
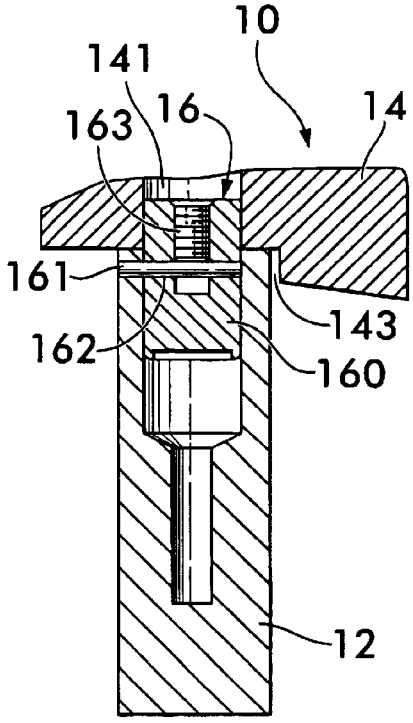
FIG. 3 is a cross-sectional view of the brake assembly taken along line 3—3 in FIG. 2.

Referring now to the drawings, simultaneous reference will be made to FIGS. 1–6 where FIGS. 1–3 depict various views of an embodiment of the pressure-released brake assembly of the present invention, and where FIGS. 4–6 depict isolated views of the various components (i.e., simple element or sub-assemblies) used to construct the brake assembly. While only one brake assembly will be shown and described herein, it is to be understood that several brake assemblies would typically be used to brake/restrain a projectile in a launch tube. Further, it is to be understood that the brake assembly can be modified in a number of ways (e.g., size, shape, materials used for various components, etc.) without departing from the scope of the present invention.

The complete brake assembly (FIGS. 1–3) is referenced generally by numeral 10. Brake assembly 10 has the following three main components: a brake assembly housing 12, a brake pad 14, and at least two pressure-released pin assemblies 16 that couple brake pad 14 to housing 12 until a launch pressure acts thereon as will be explained further below. Housing 12 is shown in isolation in FIG. 4. Brake pad 14 is shown in isolation in FIG. 5. One of pin assemblies 16 is shown in isolation in FIG. 6.

Housing 12 is configured for fixed coupling or attachment to a projectile (not shown) such that brake assembly 10 is rigidly coupled to the projectile with brake pad 14 extending out from the side of the projectile. For example, a screw or bolt hole 120 can be provided in housing 12 to facilitate attachment to a projectile. Housing 12 is configured such that, once housing 12 is attached to a projectile, brake pad 14 is positioned by housing 12 to engage an interior portion of a launch tube (not shown) as the projectile is positioned (e.g., rammed) therein. The type of attachment of housing 12 for proper positioning of brake pad 14 is not a limitation of the present invention.

Housing 12 has at least two cavities 121 and 122 defined therein. Cavities 121 and 122 are positioned in housing 12 such that, when housing 12 is attached to a projectile, the longitudinal axis of each of cavities 121 and 122 extends substantially radially outward from the projectile in a cross-sectional plane of a launch tube holding the projectile. In terms of the figures used herein, FIG. 2 illustrates brake assembly 10 as it would appear in a cross-sectional plane of the launch tube. By having cavities 121 and 122 extending radially outward from the projectile to which housing 12 is attached, cavities 121 and 122 are slightly angled towards one another as shown.

Each of cavities 121 and 122 is the same. Therefore, a detailed description of just cavity 121 will be presented herein. As is most easily seen in the isolated view depicted in FIG. 4, cavity 121 is defined by large diameter portion 121A (adjoining brake pad 14) and a decreased diameter portion 121B that adjoins large diameter portion 121A. Large diameter portion 121A is sized to loosely to receive pin 160 of pin assembly 16, while decreased diameter portion 121B is sized smaller than the diameter of pin 160.

Brake pad 14 adjoins housing 12 and forms the braking/restraining surface of brake assembly 10 that cooperates with an interior portion of a launch tube. To assure a good braking relationship between brake pad 14 and a launch tube, brake pad 14 has it's top surface 140 shaped to complement the shape of the interior portion of the launch tube that it will contact. To further facilitate a good braking relationship, brake pad 14 is typically made from a malleable material such as copper, a fully annealed aluminum, a soft fully annealed steel, etc.

The particular shape and size of brake pad 14 can be tailored to meet specific application requirements without departing from the scope of the present invention. For example, brake pad 14 can have a notch 143 formed therein to facilitate positioning thereof on housing 12 and to facilitate braking action when the projectile to which brake assembly 10 is attached is rammed into it's launch tube.

Regardless of it's shape, size and/or material construction, brake pad 14 has holes 141 and 142 formed therethrough. Holes 141 and 142 are sized and positioned to align with the respective large diameter portions 121A and 122A of cavities 121 and 122. Thus, holes 141 and 142 can loosely accommodate one pin 160 therein. Channels 144 and 145 can be formed in brake pad 14 to facilitate the transfer of launch pressure gases into each of holes 141 and 142, respectively, as will be explained further below.

Prior to launching of a projectile to which it is coupled, brake assembly 10 serves to first brake the projectile at a particular location in a launch tube during the loading (i.e., ramming) of the projectile, and then restrains the projectile in it's loaded position until launch. To accomplish this, each of pin assemblies 16 is designed to position pin 16 partially in one of holes 141 and 142 and partially in a respective one of large diameter portions 121A and 122A of cavities 121 and 122. Such positioning of pin assemblies 16 in combination with the above-described angular relationship between cavities 121 and 122 couples brake pad 14 to housing 12 without the need for any fasteners or adhesives. As will be explained further below, this feature is critical when brake assembly 10 must release the projectile.

To maintain each of pin assemblies 16 at the above-described position, a retaining wire 161 extends through a lateral bore 162 in pin 160 and into a bore 123 in housing 12. Wire 161 is held in place by means of a set screw 163 threaded coaxially into pin 160 until it applies pressure to wire 161. As best seen in FIG. 6, pin 160 can have a counter bore 164 formed in the end thereof that faces decreased diameter portions 121B or 122B. The resulting annular lip 165 formed by counter bore 164 is deformed at launch to form a gas seal as will be explained further below.

As mentioned above, several of the above-described brake assembly 10 would typically be coupled to the side of a projectile such that, when the projectile is loaded into a launch tube, all of the housings' cavities lie in a cross-sectional plane of a projectile launch tube. The malleable nature of each brake pad 14 allows each brake assembly 10 to form a friction fit with an interior of the projectile launch tube as the projectile is loaded therein. The friction fit is sufficient to both brake and restrain the projectile. When the projectile is to be launched with a high pressure gas (e.g., from a high pressure supply, from gas generated when propellant(s) combust, etc) some of the gas is directed into holes 141 and 142 via channels 144 and 145, respectively, where it then acts on one end of each pin 160. Since the other end of each pin is essentially at atmospheric pressure prior to launch, the high pressure gas acting on each pin 160 (e.g., at least 10,000 pounds per square inch) causes the failure of wire 161. The loose fit of each pin 160 in large diameter portion 121A or 122A permits each pin 160 to be driven further into cavity 121 or 122 until they abut the respective decreased diameter portions 121B and 122B. At the same time, this causes pins 160 to disengage from holes 141 and 142 in brake pad 14. Thus, the only remaining force holding brake pad 14 to housing 12 is friction which is easily overcome as the projectile is driven forward in the launch tube by the launch pressure.

When each pin 160 reaches decreased diameter portion 121B or 122B, annular lip 165 deforms (e.g., crushes) to form a gas seal to prevent any of the high launch pressure gas from getting beneath pin 160. Note that if this were to occur, pins 160 might be projected out of cavity 121 or 122. The volume provided by each of decreased diameter portions 121B and 122B also limits pressure build up beneath each pin 160.

The advantages of the present invention are numerous. The brake assembly brakes and restrains a projectile in a launch tube prior to launch, and then automatically releases the projectile when a launch pressure is generated. The brake assembly's brake pad is held in its pre-launch position by pin assemblies that undergo no stress during the loading of a projectile. Thus, the brake assembly's integrity is assured throughout projectile loading and pre-launch. Only a launch pressure will cause the brake assembly to release it's projectile.

Although the invention has been described relative to a specific embodiment thereof, there are numerous variations and modifications that will be readily apparent to those skilled in the art in light of the above teachings. For example, each of pins 160 can have a lubricant disposed thereabout to facilitate their movement in cavities 121 or 122. Lubricant can also be applied to the interface between housing 12 and brake pad 14 to minimize friction forces therebetween when pins 160 are driven out of engagement with brake pad 14. It is therefore to be understood that, within the scope of the appended claims, the invention may be practiced other than as specifically described.

What is claimed as new and desired to be secured by Letters Patent of the United States is:

1. A pressure-released brake assembly for restraining a projectile in a launch tube prior to launch and for automatically releasing the projectile at launch, said brake assembly comprising:

a housing configured for fixed attachment to a projectile, said housing defining a plurality of cavities therein, each of said plurality of cavities having a longitudinal axis that extends substantially radially out from the projectile when said housing is attached thereto wherein at least two of said plurality of cavities are angled towards one another;

a brake pad adjoining said housing and having a plurality of holes formed therethrough with each of said plurality of holes aligned with one of said plurality of cavities in said housing;

a pin sized to loosely fit in each of said plurality of holes and at least a portion of each of said plurality of cavities; and means for positioning each said pin to reside partially in one of said plurality of holes and partially in a correspondingly aligned one of said plurality of cavities wherein said brake pad is coupled to said housing and wherein, when a launch pressure is generated in the launch tube, said launch pressure acts on each said pin via said plurality of holes causing said means for positioning to fail whereby each said pin is driven out of engagement with said brake pad so that said brake pad is uncoupled from said housing.

2. A brake assembly as in claim 1 wherein said brake pad is shaped for complementary cooperation with an interior portion of the launch tube.

3. A brake assembly as in claim 1 wherein said brake pad is made from a malleable material.

4. A brake assembly as in claim 1 wherein each of said plurality of cavities has a first portion and a second portion, said first portion adjoining one of said plurality of holes in said brake pad and sized to receive said pin, said second portion adjoining said first portion and having a diameter smaller than that of said pin wherein, when said pin is driven out of engagement with said brake pad, one end of said pin travels in said first portion until reaching said second portion.

5. A brake assembly as in claim 4 wherein each said pin has a counter bore formed therein at said one end thereof.

6. A brake assembly as in claim 1 wherein, for each said pin, said means for positioning comprises:

a wire passing through said housing and said pin when said pin resides partially in said one of said plurality of holes and partially in said correspondingly aligned one of said plurality of cavities; and a screw threaded into said pin for applying pressure to said wire.

7. A brake assembly as in claim 1 further comprising channels formed in said brake pad for directing said launch pressure into each of said plurality of holes.

8. A brake assembly as in claim 1 further comprising a lubricant disposed about each said pin, and between said brake pad and said housing.

9. A pressure-released brake assembly for restraining a projectile in a launch tube prior to launch and for automatically releasing the projectile at launch, said brake assembly comprising:

a housing configured for fixed attachment to the side a projectile, said housing defining first and second cavities therein that lie in a cross-sectional plane of the launch tube, each of said first and second cavities having a longitudinal axis that extends substantially radially out from the projectile when said housing is attached thereto;

a brake pad adjoining said housing and having first and second holes formed therethrough, said first hole aligned with said first cavity and said second hole aligned with said second cavity;

a first pin sized to loosely fit in said first hole and at least a portion of said first cavity;

a second pin sized to loosely fit in said second hole and at least a portion of said second cavity;

first means for positioning said first pin to reside partially in said first hole and partially in said first cavity; and second means for positioning said second pin to reside partially in said second hole and partially in said second cavity wherein said brake pad is coupled to said housing by said first and second pins, and wherein, when a launch pressure is generated in the launch tube, said launch pressure acts on said first pin via said first hole and said second pin via said second hole, wherein said first means and said second means fail whereby said first pin and said second pin are driven out of engagement with said brake pad so that said brake pad is uncoupled from said housing.

10. A brake assembly as in claim 9 wherein said brake pad is shaped for complementary cooperation with an interior portion of the launch tube.

11. A brake assembly as in claim 9 wherein said brake pad is made from a malleable material.

12. A brake assembly as in claim 9 wherein each of said first and second cavities has a decreased diameter portion, one end of which prevents further movement of a respective one of said first and second pins after they are driven out of engagement with said brake pad.

13. A brake assembly as in claim 12 wherein each of said first and second pins has a counter bore formed therein at one end thereof that encounters said one end of said decreased diameter portion.

14. A brake assembly as in claim 9 wherein, prior to generation of said launch pressure, said first means comprises a first wire passing through said housing and said first pin, and a first screw threaded into said first pin for applying pressure to said first wire, and said second means comprises a second wire passing through said housing and said second pin, and a second screw threaded into said second pin for applying pressure to said second wire.

15. A brake assembly as in claim 9 further comprising channels formed in said brake pad for directing said launch pressure into each of said first and second holes.

16. A brake assembly as in claim 9 further comprising a lubricant disposed (i) about said first pin and said second pin, and (ii) between said brake pad and said housing.

17. A pressure-released brake assembly for restraining a projectile in a launch tube prior to launch and for automatically releasing the projectile at launch, said brake assembly comprising:

a housing configured for fixed attachment to the side a projectile, said housing defining first and second cavities therein that lie in a cross-sectional plane of the launch tube, each of said first and second cavities having a longitudinal axis that extends substantially radially out from the projectile when said housing is attached thereto wherein said first and second cavities are angled towards one another, each of said first and second cavities defined by a large diameter portion and a decreased diameter portion adjoining said large diameter portion;

a brake pad adjoining said housing and having first and second holes formed therethrough, said first hole aligned with said large diameter portion of said first cavity and said second hole aligned with said large diameter portion of said second cavity;

a first pin sized to loosely fit in said first hole and said large diameter portion of said first cavity, said first pin having a diameter that is larger than said decreased diameter portion of said first cavity;

a second pin sized to loosely fit in said second hole and said large diameter portion of said second cavity, said second pin having a diameter that is larger than said decreased diameter portion of said second cavity;

first means for positioning said first pin to reside partially in said first hole and partially in said large diameter portion of said first cavity; and second means for positioning said second pin to reside partially in said second hole and partially in said large diameter portion of said second cavity wherein said brake pad is coupled to said housing by said first and second pins, and wherein, when a launch pressure is generated in the launch tube, said launch pressure acts on said first pin via said first hole and said second pin via said second hole, wherein said first means and said second means fail due to said launch pressure whereby said first pin and said second pin are driven out of engagement with said brake pad so that said brake pad is uncoupled from said housing.

18. A brake assembly as in claim 17 wherein said brake pad is shaped for complementary cooperation with an interior portion of the launch tube.

19. A brake assembly as in claim 17 wherein said brake pad is made from a malleable material.

20. A brake assembly as in claim 17 wherein each of said first and second pins has a counter bore formed therein at one end thereof that faces said decreased diameter portion of said first and second cavities, respectively.

21. A brake assembly as in claim 17 wherein, prior to generation of said launch pressure, said first means comprises a first wire passing through said housing and said first pin, and a first screw threaded into said first pin for applying pressure to said first wire, and said second means comprises a second wire passing through said housing and said second pin, and a second screw threaded into said second pin for applying pressure to said second wire.

22. A brake assembly as in claim 17 further comprising channels formed in said brake pad for directing said launch pressure into each of said first and second holes.

23. A brake assembly as in claim 17 further comprising a lubricant disposed (i) about said first pin and said second pin, and (ii) between said brake pad and said housing.

* * * * *